US006945184B2

(12) United States Patent
Frost et al.

(10) Patent No.: US 6,945,184 B2
(45) Date of Patent: Sep. 20, 2005

(54) DOUBLE END SERVO SCROLL PATTERN ATTACHMENT WITH SINGLE END REPEAT CAPABILITY FOR TUFTING MACHINE

(75) Inventors: Steven Frost, Signal Mountain, TN (US); Richard Prichard, Hixson, TN (US)

(73) Assignee: Tuftco Corporation, Chattanooga, TN (US)

( * ) Notice: Subject to any disclaimer, the term of this patent is extended or adjusted under 35 U.S.C. 154(b) by 7 days.

(21) Appl. No.: 10/966,319

(22) Filed: Oct. 15, 2004

(65) Prior Publication Data

US 2005/0139134 A1 Jun. 30, 2005

Related U.S. Application Data

(63) Continuation of application No. 10/420,290, filed on Apr. 22, 2003, now Pat. No. 6,877,447, which is a continuation-in-part of application No. 10/227,376, filed on Aug. 23, 2002, now Pat. No. 6,550,407.

(60) Provisional application No. 60/511,588, filed on Oct. 15, 2003.

(51) Int. Cl.[7] ..... D05C 15/18
(52) U.S. Cl. ..... 112/80.73
(58) Field of Search ..... 112/80.73, 80.23, 112/475.23, 80.01, 475.01, 220

(56) References Cited

U.S. PATENT DOCUMENTS 6,834,601 B2 * 12/2004 Card et al. ..... 112/80.23
2005/0056197 A1 * 3/2005 Card et al. ..... 112/80.23

* cited by examiner

*Primary Examiner*—Peter Nerbun
(74) *Attorney, Agent, or Firm*—Douglas T. Johnson

(57) ABSTRACT

A tufting machine having a servo driven yarn feed attachment adapted to feed two yarns on each yarn feed roll is provided with a tube bank that allows tufting of two single end patterns on the tufting machine from one set of yarn drives.

23 Claims, 12 Drawing Sheets

| ROLL | TUBE BANK | NEEDLE | STITCH HEIGHT | | | | | | | | | |
|---|---|---|---|---|---|---|---|---|---|---|---|---|
| A | | 1 | H | H | M | M | L | L | M | M | H | H |
| A | | 2 | H | M | M | L | L | M | M | H | H | M |
| B | | 3 | M | M | L | L | M | M | H | H | M | M |
| B | | 4 | M | L | L | M | M | H | H | M | M | L |
| C | | 5 | L | L | M | M | H | H | M | M | L | L |
| C | | 6 | H | H | M | H | L | L | M | M | H | H |
| D | | 7 | H | M | M | L | L | M | M | H | H | M |
| D | | 8 | M | M | L | L | M | M | H | H | M | M |
| E | | 9 | M | L | L | M | M | H | H | M | M | L |
| E | | 10 | L | L | M | M | H | H | M | M | L | L |

| ROLL | NEEDLE | STITCH HEIGHT | | | | | | | | | |
|---|---|---|---|---|---|---|---|---|---|---|---|
| A | 1 | H | H | M | M | L | L | M | M | H | H |
| A | 2 | H | H | M | M | L | L | M | M | H | H |
| B | 3 | H | M | M | L | L | M | M | H | H | M |
| B | 4 | H | M | M | L | L | M | M | H | H | M |
| C | 5 | M | M | L | L | M | M | H | H | M | M |
| C | 6 | M | M | L | L | M | M | H | H | M | M |
| D | 7 | M | L | L | M | M | H | H | M | M | L |
| D | 8 | M | L | L | M | M | H | H | M | M | L |
| E | 9 | L | L | M | M | H | H | M | M | L | L |
| E | 10 | L | L | M | M | H | H | M | M | L | L |

*Fig. 6A*

| ROLL | NEEDLE | TUFT APPEARANCE | | | | | | | | | |
|---|---|---|---|---|---|---|---|---|---|---|---|
| A | 1 | O | O | o | o | o | o | o | o | O | O |
| A | 2 | O | O | o | o | o | o | o | o | O | O |
| B | 3 | O | o | o | o | o | o | o | O | O | o |
| B | 4 | O | o | o | o | o | o | o | O | O | o |
| C | 5 | o | o | o | o | o | o | O | O | o | o |
| C | 6 | o | o | o | o | o | o | O | O | o | o |
| D | 7 | o | o | o | o | o | O | O | o | o | o |
| D | 8 | o | o | o | o | o | O | O | o | o | o |
| E | 9 | o | o | o | o | O | O | o | o | o | o |
| E | 10 | o | o | o | o | O | O | o | o | o | o |

*Fig. 6B*

| ROLL | TUBE BANK | NEEDLE | STITCH HEIGHT | | | | | | | | | |
|---|---|---|---|---|---|---|---|---|---|---|---|---|
| A | | 1 | H | H | M | M | L | L | M | M | H | H |
| A | | 2 | H | M | M | L | L | M | M | H | H | M |
| B | | 3 | M | M | L | L | M | M | H | H | M | M |
| B | | 4 | M | L | L | M | M | H | H | M | M | L |
| C | | 5 | L | L | M | M | H | H | M | M | L | L |
| C | | 6 | H | H | M | H | L | L | M | M | H | H |
| D | | 7 | H | M | M | L | L | M | M | H | H | M |
| D | | 8 | M | M | L | L | M | M | H | H | M | M |
| E | | 9 | M | L | L | M | M | H | H | M | M | L |
| E | | 10 | L | L | M | M | H | H | M | M | L | L |

*Fig. 15A*

| NEEDLE | TUFT APPEARANCE | | | | | | | | | |
|---|---|---|---|---|---|---|---|---|---|---|
| 1 | O | O | o | o | o | o | o | o | O | O |
| 2 | O | o | o | o | o | o | o | O | O | o |
| 3 | o | o | o | o | o | o | O | O | o | o |
| 4 | o | o | o | o | o | O | O | o | o | o |
| 5 | o | o | o | o | O | O | o | o | o | o |
| 6 | O | O | o | o | o | o | o | o | O | O |
| 7 | O | o | o | o | o | o | o | O | O | o |
| 8 | o | o | o | o | o | o | O | O | o | o |
| 9 | o | o | o | o | o | O | O | o | o | o |
| 10 | o | o | o | o | O | O | o | o | o | o |

*Fig. 15B*

| ROLL | TUBE BANK | NEEDLE | STITCH HEIGHT | | | | | | | | | |
|---|---|---|---|---|---|---|---|---|---|---|---|---|
| A | | 1 | H | H | M | M | L | L | M | M | H | H |
| A | | 2 | H | M | M | L | L | M | M | H | H | M |
| B | | 3 | M | M | L | L | M | M | H | H | M | M |
| B | | 4 | M | L | L | M | M | H | H | M | M | L |
| C | | 5 | L | L | M | M | H | H | M | M | L | L |
| C | | 6 | L | L | M | M | H | H | M | M | L | L |
| D | | 7 | M | L | L | M | M | H | H | M | M | L |
| D | | 8 | M | M | L | L | M | M | H | H | M | M |
| E | | 9 | H | M | M | L | L | M | M | H | H | M |
| E | | 10 | H | H | M | M | L | L | M | M | H | H |

*Fig. 15C*

| NEEDLE | TUFT APPEARANCE | | | | | | | | | |
|---|---|---|---|---|---|---|---|---|---|---|
| 1 | O | O | o | o | o | o | o | o | O | O |
| 2 | O | o | o | o | o | o | o | O | O | o |
| 3 | o | o | o | o | o | o | O | O | o | o |
| 4 | o | o | o | o | o | O | O | o | o | o |
| 5 | o | o | o | o | O | O | o | o | o | o |
| 6 | o | o | o | o | O | O | o | o | o | o |
| 7 | o | o | o | o | o | O | O | o | o | o |
| 8 | o | o | o | o | o | o | O | O | o | o |
| 9 | O | o | o | o | o | o | o | O | O | o |
| 10 | O | O | o | o | o | o | o | o | O | O |

*Fig. 15D*

DOUBLE END SERVO SCROLL PATTERN ATTACHMENT WITH SINGLE END REPEAT CAPABILITY FOR TUFTING MACHINE

This application claims priority to the Oct. 15, 2003 filing date of U.S. provisional patent application Ser. No. 60/511,588. This application is also a continuation in part of U.S. Ser. No. 10/420,290 filed Apr. 22, 2003 now U.S. Pat. No. 6,877,447, which is in turn a continuation in part of U.S. Ser. No. 10/227,376 filed Aug. 23, 2002, issued as U.S. Pat. No. 6,550,407, each of which are incorporated herein by reference.

BACKGROUND OF THE INVENTION

This invention relates to a yarn feed mechanism for a tufting machine and more particularly to a scroll-type pattern controlled yarn feed where two yarns may be wound on a separate yarn feed roll, and each yarn feed roll is driven by an independently controlled servo motor. An optional tube bank permits the yarns to either bypass the tube bank and be tufted in a coarse two gauge pattern across the full width of the tufting machine, or pass through the tube bank to tuft two single gauge patterns of half the width of the tufting machine.

Pattern control yarn feed mechanisms for multiple needle tufting machines are well known in the art and may be generally characterized as either roll-type or scroll-type pattern attachments. Roll type attachments are typified by J. L. Card, U.S. Pat. No. 2,966,866 which disclosed a bank of four pairs of yarn feed rolls, each of which is selectively driven at a high speed or a low speed by the pattern control mechanism. All of the yarn feed rolls extend transversely the entire width of the tufting machine and are journaled at both ends. There are many limitations on roll-type pattern devices. Perhaps the most significant limitations are: (1) as a practical matter, there is not room on a tufting machine for more than about eight pairs of yarn feed rolls; (2) the yarn feed rolls can be driven at only one of two, or possibly three speeds, when the traditional construction utilizing clutches is used—a wider selection of speeds is possible when using direct servo motor control, but powerful motors and high gear ratios are required and the shear mass involved makes quick stitch by stitch adjustments difficult; and (3) the threading and unthreading of the respective yarn feed rolls is very time consuming as yarns must be fed between the yarn feed rolls and cannot simply be slipped over the end of the rolls, although the split roll configuration of Watkins, U.S. Pat. No. 4,864,946 addresses this last problem.

Scroll-type pattern attachments are disclosed in J. L. Card, U.S. Pat. No. 2,862,465, and are shown projecting transversely to the row of needles, although subsequent designs have been developed with the yarn feed rolls parallel to the row of needles as in Hammel, U.S. Pat. No. 3,847,098. Typical of scroll type attachments is the use of a tube bank to guide yarns from the yarn feed rolls on which they are threaded to the appropriate needle. In this fashion yarn feed rolls need not extend transversely across the entire width of the tufting machine and it is physically possible to mount many more yarn feed rolls across the machine. Typically, scroll pattern attachments have between 36 and 120 sets of rolls, and by use of electrically operated clutches each set of rolls can select from two, or possibly three, different speeds for each stitch. The use of yarn feed tubes introduces additional complexity and expense in the manufacture of the tufting machine; however, the greater problem is posed by the differing distances that yarns must travel through yarn feed tubes to their respective needles. Yarns passing through relatively longer tubes to relatively more distant needles suffer increased drag resistance and are not as responsive to changes in the yarn feed rates as yarns passing through relatively shorter tubes. Accordingly, in manufacturing tube banks, compromises have to be made between minimizing overall yarn drag by using the shortest tubes possible, and minimizing yarn feed differentials by utilizing the longest tube required for any single yarn for every yarn. Tube banks, however well designed, introduce significant additional cost in the manufacture of scroll-type pattern attachments.

One solution to the tube bank problems, which also provides the ability to tuft full width patterns is the full repeat scroll invention of Bradsley, U.S. Pat. No. 5,182,997, which utilizes rocker bars to press yarns against or remove yarns from contact with yarn feed rolls that are moving at predetermined speeds. Yarns can be engaged with feed rolls moving at one of two preselected speeds, and while transitioning between rolls, yarns are briefly left disengaged, causing those yarns to be slightly underfed for the next stitch.

Another significant limitation of scroll-type pattern attachments is that each pair of yarn feed rolls is mounted on the same set of drive shafts so that for each stitch, yarns can only be driven at a speed corresponding to one of those shafts depending upon which electromagnetic clutch is activated. Accordingly, it has not proven possible to provide more than two, or possibly three, stitch heights for any given stitch of a needle bar.

As the use of servo motors to power yarn feed pattern devices has evolved, it has become well known that it is desirable to use many different stitch lengths in a single pattern. Prior to the use of servo motors, yarn feed pattern devices were powered by chains or other mechanical linkage with the main drive shaft and only two or three stitch heights, in predetermined ratios to the revolutions of the main drive shaft, could be utilized in an entire pattern. With the advent of servo motors, the drive shafts of yarn feed pattern devices may be driven at almost any selected speed for a particular stitch.

Thus a servo motor driven pattern device might run a high speed drive shaft to feed yarn at 0.9 inches per stitch if the needle bar does not shift, 1.0 inches if the needle bar shifts one gauge unit, and 1.1 inches if the needle bar shifts two gauge units. Other slight variations in yarn feed amounts are also desirable, for instance, when a yarn has been sewing low stitches and it is next to sew a high stitch, the yarn needs to be slightly overfed so that the high stitch will reach the full height of subsequent high stitches. Similarly, when a yarn has been sewing high stitches and it is next to sew a low stitch, the yarn needs to be slightly underfed so that the low stitch will be as low as the subsequent low stitches. Therefore, there is a need to provide a pattern control yarn feed device capable of producing scroll-type patterns and of feeding the yarns from each yarn feed roll at an individualized rate.

Commonly assigned patent 6,224,203, invented by Morgante et. al., incorporated herein by reference, addressed many of these concerns by creating a single-end servo attachment. This servo-scroll attachment allowed each end of yarn across the entire width of a full-size tufting machine to be independently controlled. By providing each end of yarn with an independently driven yarn feed roll, the use of the tube bank was eliminated, while allowing the creation of patterns that do not repeat across the entire width of a broadloom tufting machine. Despite the advances associated with a single-end servo scroll attachments, the cost of the single end attachment makes its use for generic or commodity carpeting financially disadvantageous. Accordingly, U.S. Pat. No. 6,550,407 from which this application claims priority, proposed the use of two yarns on each yarn feed roll being fed to adjacent needles. This eliminated the need for half of the servo motors and associated yarn drive apparatus, however the resulting patterns had less definition.

SUMMARY OF THE INVENTION

It is therefore an object of this invention to provide in a multiple needle tufting machine a pattern controlled yarn feed mechanism incorporating a plurality of individually driven yarn feed rolls carrying two yarn ends capable of creating high definition patterns.

The yarn feed mechanism made in accordance with this invention includes a plurality of yarn feed rolls, each being directly driven by a servo motor, where up to approximately twenty yarn feed rolls with attached servo motors, may preferably be mounted upon an arched mounting arm which is attached to the tufting machine. A plurality of mounting arms may extend across the tufting machine. Each yarn feed roll is driven at a speed dictated by its corresponding servo motor and each servo motor can be individually controlled.

It is a further object of this invention to provide a pattern controlled yarn feed mechanism with many of the benefits of a single-end motor driven yarn feed attachment at reduced cost.

It is yet another object of the invention to provide an optional tube bank that permits the tufting of two adjacent repeats of a carpet pattern and/or a carpet pattern and its mirror, in single gauge definition when feeding two yarns on each yarn feed roll. When manufacturing rugs on a broad loom tufting machine, each carpet pattern may have about half the width of the tufting machine in order to permit simultaneous tufting of two rugs.

BRIEF DESCRIPTION OF THE DRAWINGS

FIGS. 6A and 6B illustrate the tufting pattern dictated by double-end servo scroll attachments without a tube bank showing identical tufting heights for each needle pair fed by a given servo motor.

FIGS. 15A–D are illustrations of the tufting patterns created by a double end servo scroll attachment feeding yarns through the tube bank design of FIG. 14 to a tufting machine.

DETAILED DESCRIPTION OF THE INVENTION

Figure 1:
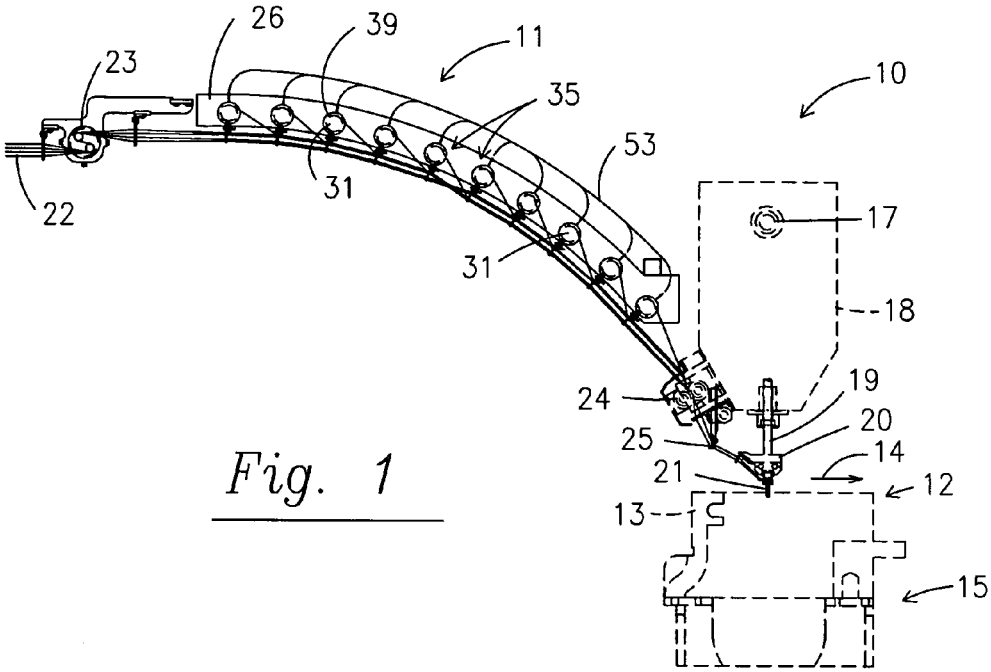
FIG. 1 is a side elevation view of the multiple-needle tufting machine incorporating an embodiment of a double-end pattern control yarn feed mechanism without a tube bank.

Referring to the drawings in more detail, FIG. 1 discloses a multiple needle tufting machine 10 upon the front of which is mounted a pattern control yarn feed attachment 11 in accordance with this invention. It will be understood that it is possible to mount pattern control yarn feed attachments 11 on both sides of a tufting machine 10 when desired. The machine 10 includes a housing 12 and a bed frame 13 upon which is mounted a needle plate, not shown, for supporting a base fabric adapted to be moved through the machine 10 from front to rear in the direction of the arrow 14 by front and rear fabric rollers. The bed frame 13 is in turn mounted on the base 15 of the tufting machine 10.

A main drive motor drives a rotary main drive shaft 17 mounted in the head 18 of the tufting machine. Drive shaft 17 in turn causes push rods 19 to move reciprocally toward and away from the base fabric. This causes needle bar 20 to move in a similar fashion. Needle bar 20 supports a plurality of preferably uniformly spaced needles 21 aligned transversely to the fabric feed direction 14.

In operation, yarns 22 are fed through tension bars 23, into the pattern control yarn feed device 11. After exiting the yarn feed device 11, yarns 22 are guided in a conventional manner through yarn puller rollers 24, and yarn guides 25 to needles 21. A looper mechanism, not shown, in the base 15 of the machine 10 acts in synchronized cooperation with the needles 21 to seize loops of yarn 22 and form cut or loop pile tufts, or both, on the bottom surface of the base fabric in well known fashions.

In order to form a variety of yarn pile heights, a pattern controlled yarn feed mechanism 11 incorporating a plurality of yarn feed rolls adapted to be independently driven at different speeds has been designed for attachment between the tensioning bars 23 and the yarn puller rollers 24. As best disclosed in FIGS. 1 and 2, an array of yarn drives 35, each configured to carry two yarns, is assembled on an arching support bar 26 extending from the front of the tufting machine 10 and providing opposing vertical mounting surfaces 71, 72 on each of its sides and an upward facing top surface 73 (shown in FIG. 3). On the opposing side-facing surfaces 71, 72 are preferably mounted a total of twenty servo motors 31 and driven yarn feed rolls 39, ten on each side, shown in isolation in FIG. 3. It will be understood that the number of rolls on each support bar 26 may be varied for many reasons, especially in proportion to the gauge of the needles 21 on the needle bar 20. For instance, in the case of ⅛ gauge needle spacing (8 needles per inch) and support bars spaced every three inches, it would be desirable to carry twelve independently driven double end yarn feed rolls on each support bar 26. In practice, the support bars 26 should carry at least about six, and preferably at least about twelve, double end servo driven yarn feed rolls 39. Typically, each support bar 26 will carry a complement of twenty servo motor driven yarn feed rolls 39, and the spacing of the support bars will be adjusted to suit the needle gauge.

Figure 4:
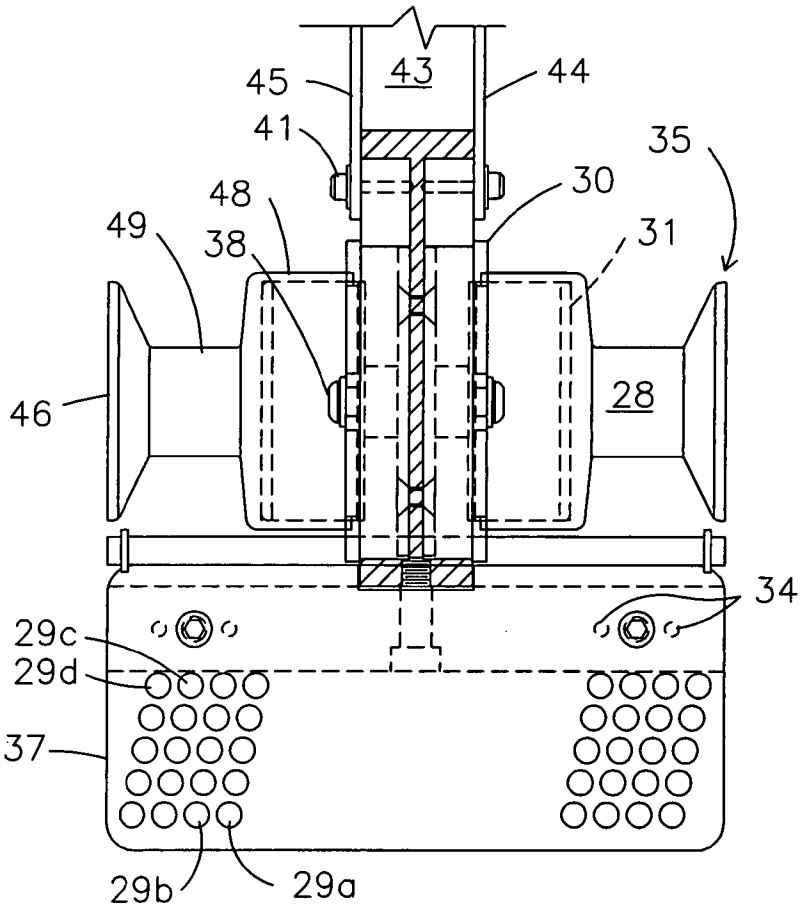
FIG. 4 is a rear elevation view of a section of a support holding two stepped down yarn feed rolls, two servo motors that control yarn feed roll rotation, and yarn guide plate.
Figure 3:
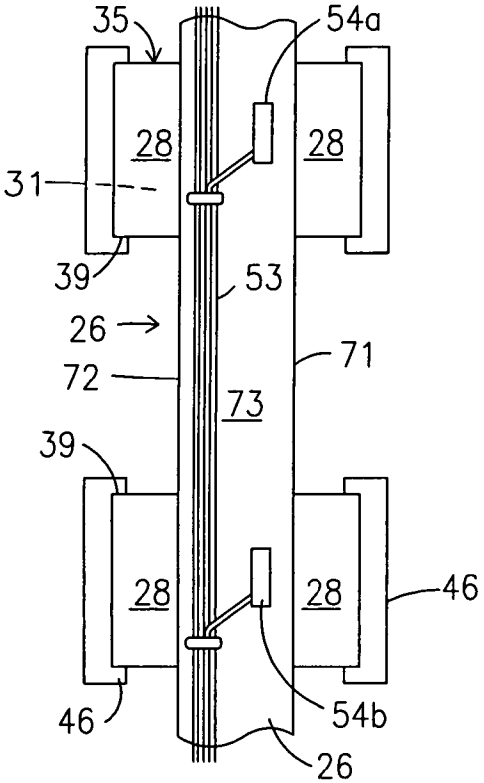
FIG. 3 is a top elevation view of a segment of a support bar with four servo driven yarn feed rolls, two on each side.

As shown in FIG. 1 and in detail in FIG. 3, the arching support bar 26 accommodates the wiring bundle 53 from the motors via the wiring path 43, shown in FIG. 4, built into the arching support bar 26, which facilitates the wiring of the motors. Wiring plugs 54*a* and 54*b* join the wiring bundle 53 to leads connected to the motors 31 and allow for easy servicing. Wiring bundle 53 is in turn connected to servo motor controller board, which may be in a central cabinet or installed on an arching support 26.

Each double end yarn drive 35 consists of a yarn feed roll 39 and a servo motor 31. In one embodiment, the servo motor 31 directly drives the yarn feed roll 39, which may be advantageously attached concentrically about the servo motor 31, as shown in FIG. 3. Preferably a yarn 22 is directed by yarn guide plates 27 and other conventional designs so that the yarn is wrapped around nearly 180° of the circumference of the yarn feeding surface 28 of the yarn feed roll, and at least about 135° of said circumference. As shown in FIG. 4, yarn guide posts 34 may protrude from the yarn guide plates 27 in the general direction of the yarn feed, and help ensure the proper placement of two yarns 22 on yarn feed rolls 39.

Figure 2:
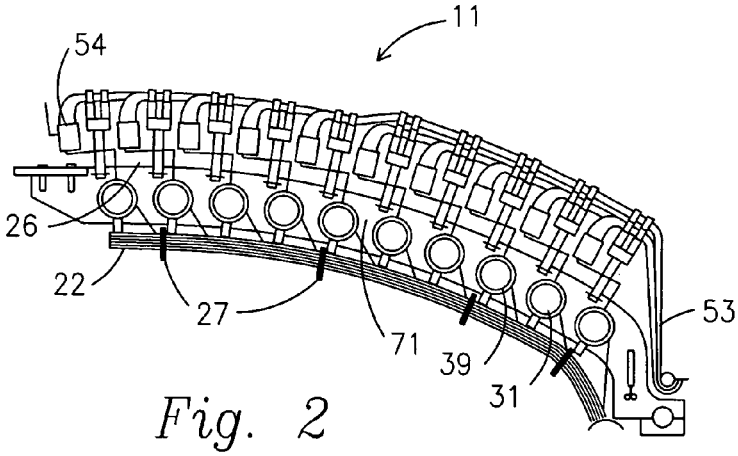
FIG. 2 is a side elevation view of a similar embodiment of an arched support for a pattern control yarn feed mechanism according to the invention, shown in isolation.

It will also be noted in FIGS. 2 and 4 that yarns 22 from the yarn supply are fed through apertures 29 on the support yarn guides 27, 37. Specifically, a pair of yarns 22 for a yarn feed drive 35 on the support 26 distal from the tufting machine are fed through apertures 29*a*, 29*b* near the bottom of guides 37 until the yarns reach their associated yarn drive 35, and are fed around approximately 180° of the yarn feed roll 39 on its associated yarn drive 35, and those yarns then continue through lower apertures 29*a*, 29*b* of the remaining support yarn guides 37. Because two ends of yarn are wrapped around each of the ten yarn feed rolls 28 on one side of the attachment 11, twenty apertures 29 are required on each of the left and right sides of the yarn guide plate 37 to accommodate the yarns. Yarns 22 being wrapped and driven by a contacting yarn feed roll 39 distal from the tufting machine 10 enter the apertures 29*a*, 29*b* with each of the two yarns to a particular yarn feed roll 39 threaded through adjacent apertures. For example apertures 29*a* and 29*b* could have yarns driven by the same yarn feed roll 39. Yarns from a yarn feed roll 39 quite proximal to the tufting machine 11 would occupy apertures 29*c* and 29*d*. The apertures 29 are arranged in parallel, diagonally offset rows. The arrangement allows all the yarn ends for each of the yarn feed rolls 39 to be directed through the attachment 11 to the proper needles without introducing unwanted friction between individual yarns.

It will also be seen in FIG. 4 that the servo motors 31 are advantageously set on base plates 30 of greater diameter than the yarn feed rolls 39, which permits the base plate 30 and attached motors 31 to be mounted on the support bar 26 with several motor mount bolts 38. Additional fasteners 41 are used to secure covers 44, 45 or circuit board assemblies over support 26, thereby defining wiring path 43.

Each feed roll 39 has a yarn feeding surface 28 formed of a sand-paper like or other high friction material upon which the yarns are fed. As shown in FIG. 3, end caps 46 help ensure the yarns 22 remain on the feeding surface 28, and may protect motors 31 from dust or other contamination. Each of the yarn feed rolls 39 may be loaded with two yarns, which is a light load providing little resistance compared to the hundred or more yarns that might be carried on a roll-type yarn feed attachment, the hundreds of individual yarns typically driven by a single scroll drive shaft, or even the dozen yarns typically driven in the commonly assigned servo-scroll patent, U.S. Pat. No. 6,244,203. Because of the lighter loads involved in feeding only two yarns, the present design permits the use of small servo motors that can mount inside or outside of the yarn feed rolls 39. For instance, a typical motor for a double end yarn drive would be a 24–28 volt motor using 3 amps of power. This motor would be able to generate 5 lb-in of torque at 3 amps, having a maximum no load speed of 650 RPM. A representative motor of this type is the Full Repeat Scroll Motor by Moog, Inc. (C22944), which meets these general specifications. A motor of this type is sufficiently powerful to turn the associated yarn feed roll without the need for any gearing advantage in many situations, in which case the ratio of servo motor revolutions to yarn feed roll revolutions is 1:1.

However, in some applications, especially utilizing heavy and irregular yarns with frequent low stitch height to high stitch height yarn feed changes, additional torque may be preferred. Accordingly, modified yarn feed rolls 49 are shown in FIG. 4. These yarn feed rolls 49 have a mounting section 48 that fits over and engages servo motors 31, a stepped down diameter yarn feeding surface 28, and an end cap portion 46. The associated yarn guide plate 37 is also modified to a wider structure than that used with the yarn feed rolls 39, shown in FIG. 3, so that the apertures 29 for feeding yarns are generally aligned beneath the yarn feeding surfaces 28. By reducing the diameter of the yarn feed surface portion 28 of the yarn feed rolls, a single revolution of servo motor 31 feeds less yarn, effectively reducing the maximum yarn feed rate and increasing the torque of the yarn feed drive 35.

In commercial operation, a typical two meter, rug size tufting machine may utilize pattern controlled yarn feed devices 11 according to the embodiments of FIGS. 1–4 with approximately fourteen support bars 26, each bar bearing twenty yarn feed drives 35 thereby providing about 280 independently controlled yarn feed rolls 28. This provides the capacity to feed 560 yarns in the double end drive configuration, without the necessity of a tube bank. If any yarn feed roll 39 or associated servo motor 31 should become damaged or malfunction, the arched support bar 26 can be pivoted downward for ease of access. A replacement yarn drive 35 already fitted with a yarn feed roll 39 or 49 and a servo motor 31 can be quickly installed. This allows the tufting machine to resume operation while repairs to the damaged or malfunctioning yarn feed rolls and motor are completed, thereby minimizing machine down time.

In the novel configuration of the present invention, a four meter tufting machine may utilize about thirty support bars 26, each bar bearing twenty yarn feed drives 35 and thereby providing a total of about 600 independently controlled yarn feed rolls 28. This provides the capacity to feed 1200 yarns in double end drive configuration. When these yarns are fed into a tube bank as reflected in FIG. 14 on a four meter tufting machine, it then becomes possible to simultaneously tuft two identical or mirror image six foot wide rugs in single end resolution. If the yarns bypass the tube bank, the four meter tufting machine may still tuft full width carpet in double gauge or double end resolution.

In a typical configuration, the double end yarn drives 11 are longitudinally spaced at about four to seven inch intervals along the support bar. This spacing is necessary to ensure proper yarn travel and minimal yarn resistance and stretching while still allowing enough space between the yarn feed rolls 39 or 49 to allow minor adjustments. The distance between support bar centers carrying double end drives 35 is typically about six to eight inches but may vary. This variability is necessary because of differences in the needle gauge that may be used. For instance, a larger needle gauge will require the needles to be spread at further intervals allowing more space between the support bars. However, for smaller needle gauges, the support arms will need to be closer together due to the increased proximity of the needles. As a result of the greater spacing between support bars in this embodiment in comparison to the single end drives of U.S. Pat. No. 6,283,053, when no tube bank is employed, yarn spreaders may be used to disperse the yarns from pattern attachment 11 to the yarn puller rollers 24 and guides 25.

Figure 5A:
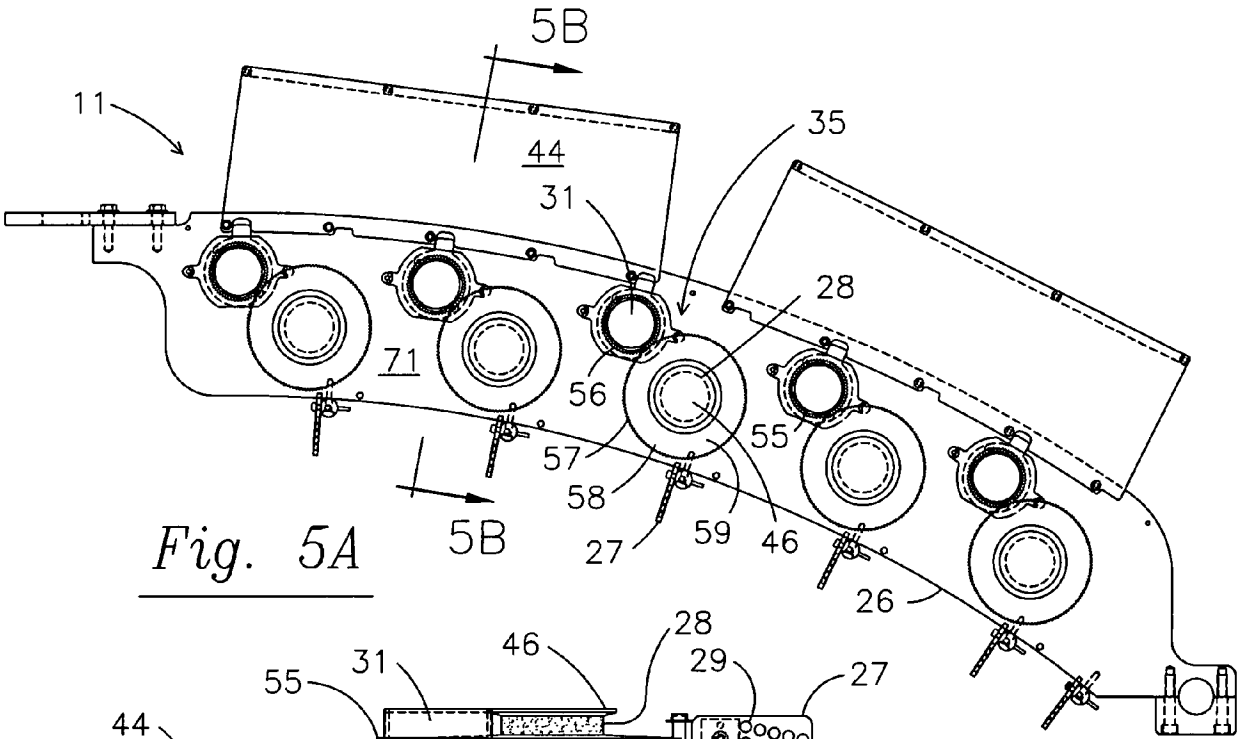
FIG. 5A is a side elevation view of a double-end pattern control yarn feed support utilizing a geared drive system.
Figure 5B:
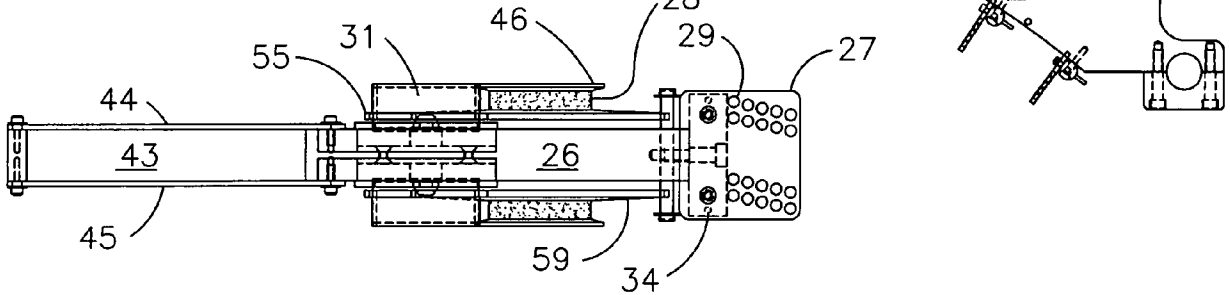
FIG. 5B is a rear elevation view of the invention of FIG. 5A, taken along a section of the support bar and showing two yarn drives and a yarn guide plate.

FIGS. 5A and 5B illustrate an alternative preferred embodiment of a double end servo yarn feed pattern attachment 11. In this embodiment, only about five servo motors 31 are mounted on each of the opposed surfaces 71, 72 of support bar 26. The greater longitudinal spacing between servo motors 31, now on the order of about eight to fifteen inches, permits the mounting of geared yarn feed rolls 59. On servo motors 31 is mounted a drive gear 55, having gear teeth 56 that mesh with teeth 57 of yarn feed roll 59. The overall diameter of the servo motor 31 is only about three inches, and the drive gear 55 adds little additional diameter. The overall diameter of the teethed section 58 of the geared yarn drive roll 59 may be between about six to nine inches. The diameter of the yarn feeding surface portion 28 on rolls 59 remains at about three inches. Thus, it now requires two or three revolutions of servo motors 31 to feed the same lengths of yarn that would have been fed by a single servo motor revolution in the embodiment of FIG. 3. The result is that the maximum yarn feed rate has been diminished and the effective torque of yarn feed drives 35 has been increased by a factor of about two or three. Unlike the extended yarn feed rolls 49 of FIG. 4, the geared rolls do not require additional lateral spacing between support bars, and about twenty-five to thirty such support bars 26 might be placed on a two meter tufting machine, with as little as 3¼ inch spacing between bar centers. Because the support bars 26 as illustrated in FIG. 5 carry twenty yarns on ten drives and are spaced just as single end drive support bars with twenty drives, no changes are necessary to spread the yarns 22 as they exit the pattern attachment 11 and proceed to the yarn puller rollers 24, guides 25 and needles 21.

It will be understood that the geared portion 56 of drive gear 55 and the teethed section 58 of geared yarn feed roll 59, are adjacent to the support bar 26, so as not to interfere with placement of yarns over end cap 46 and on the yarn feeding surfaces 28. This embodiment provides the enhanced torque desired for feeding two yarns.

FIGS. 6A and 6B illustrate the resolution characteristics of a simple carpet pattern manufactured with five double end yarn drives. Each of the yarn feed rolls A–E sends two yarn ends to adjacent needles. The yarns can be tufted with a plurality of heights, but for the sake of clarity stitch heights have been restricted to High (H), Medium (M), and Low (L). In the absence of a tube bank, the use of double end drives restricts yarns on needle pairs 1-2, 3-4, 5-6, 7-8 and 9-10 to the same stitch height, creating double stitch groupings. In practical terms the finest resolution achievable with a double end yarn feed attachment is limited to the width of two contiguous needles, or double the needle gauge. However, the stitch density is not affected. In other words fabrics with the same number of stitches per inch are produced as in products manufactured using single end yarn drives. The double end yarn drives can change stitch heights for a pair of needles just as stitch heights are changed for a single needle in a single end yarn drive. However, because both adjacent needles fed by a double end yarn drive must change to the same stitch height resulting in less definition on the finished fabric. The result is a patterned fabric having conventional stitch density, a wide range of variances in stitch height, but only half the resolution of single end yarn feed designs. A double end drive attachment permits tufting of fabrics with only half the yarn drives of a single end attachment without sacrificing any stitch count in the fabric. Double end attachments are therefore cheaper to manufacture, easier to maintain, and allow precise stitch height control tufting to enter lower margin tufting markets. With appropriate modifications in the yarn guides 27, 37, triple end and even quadruple end yarn feed attachments are also practicable, with a corresponding further loss in pattern definition. It must also be noted that the pattern design software used for tufting machines equipped with single end yarn feed attachments must be slightly modified for use with double end yarn feed attachments. Specifically, the software must be altered to require the stitches of paired needles to always be at the same heights.

The present invention allows a double end yarn feed attachment to route yarns through a tube bank and create two identical single end fabrics of half width. Thus, for the manufacture of rugs, most typically of six feet width, a four meter tufting machine equipped with a tube bank according to the present invention can simultaneously tuft two six foot wide rugs at single end definition.

Figure 7:
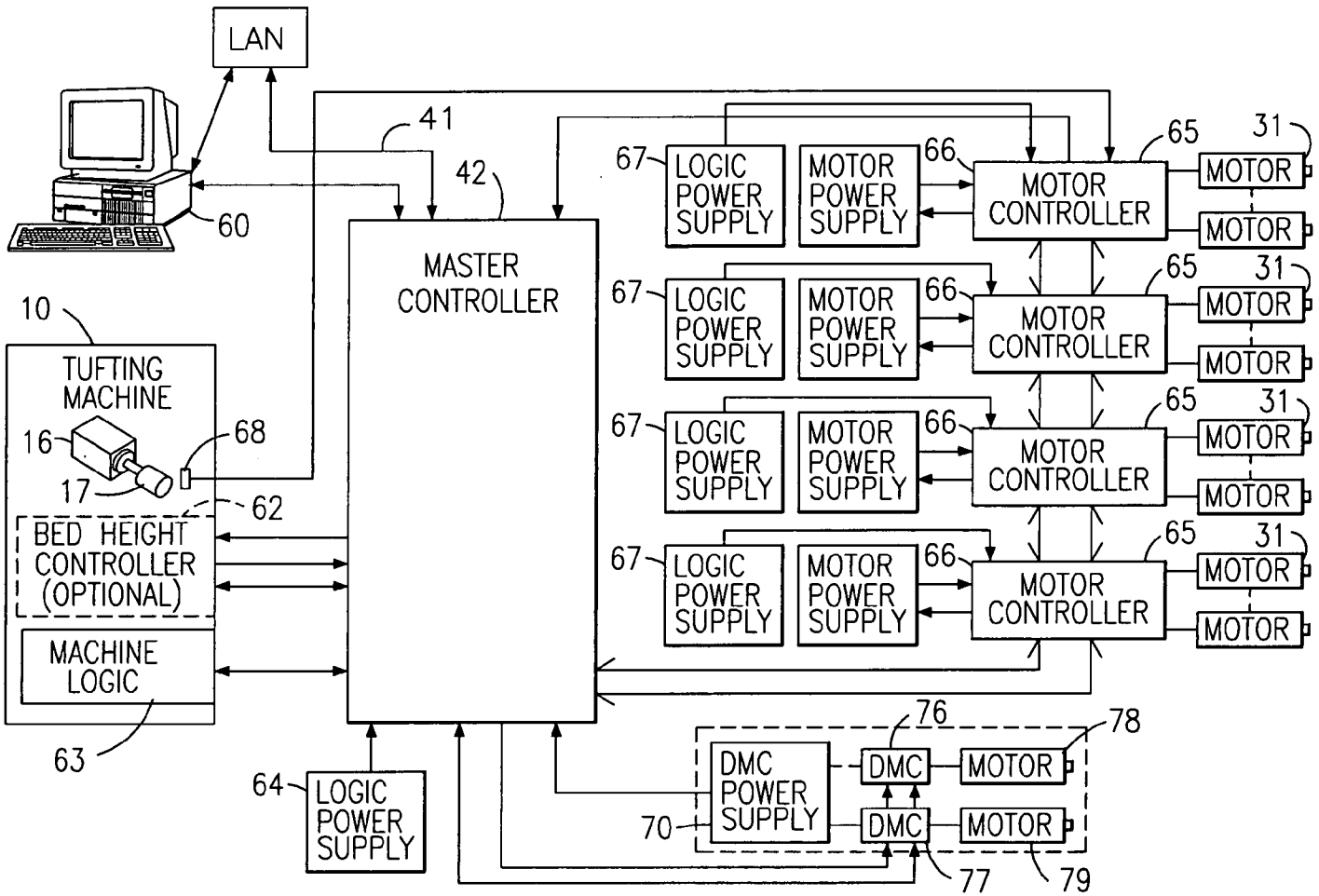
FIG. 7 is a schematic view of the electrical flow diagram for a multiple needle tufting machine incorporating a yarn feed mechanism made in accordance with the present invention.

Turning now to FIG. 7, a general electrical diagram of the double end yarn feed attachment is shown in the context of a computerized tufting machine with main drive motor 16 and drive shaft 17. A personal computer 60 is provided as a user interface, and this computer 60 may also be used to create, modify, display and install patterns in the tufting machine 10 by communication with the tufting machine master controller 42.

Due to the very complex patterns that can be tufted when individually controlling each end of yarn, many patterns will comprise large data files that are advantageously loaded to the master controller by a network connection 61; and preferably a high bandwidth network connection.

Master controller 42 preferably interfaces with machine logic 63, so that various operational interlocks will be activated if, for instance, the controller 42 is signaled that the tufting machine 10 is turned off, or if the "jog" button is depressed to incrementally move the needle bar, or a housing panel is open, or the like. Master controller 42 may also interface with a bed height controller 62 on the tufting machine to automatically effect changes in the bed height when patterns are changed. Master controller 42 also receives information from encoder 68 relative to the position of the main drive shaft 17 and preferably sends pattern commands to and receives status information from controllers 76, 77 for backing tension motor 78 and backing feed motor 79 respectively, Said motors 78,79 are powered by power supply 70. Finally, master controller 42, for the purposes of the present invention, sends ratiometric pattern information to the servo motor controller boards 65. The master controller 42 will signal particular servo motor controller board 65 that it needs to spin its particular servo motors 31 at given revolutions for the next revolution of the main drive shaft 17 in order to control the pattern design. The servo motors 31 in turn provide positional control information to their servo motor controller board 65 thus allowing two-way processing of positional information. Power supplies 67, 66 are associated with each servo motor controller board 65 and motor 31.

Master controller 42 also receives information relative to the position of the main drive shaft 17. Servo motor controller boards 65 process the ratiometric information and main drive shaft positional information from master controller 42 to direct servo motors 31 to rotate yarn feed rolls 28 the distance required to feed the appropriate yarn amount for each stitch.

Figure 8:
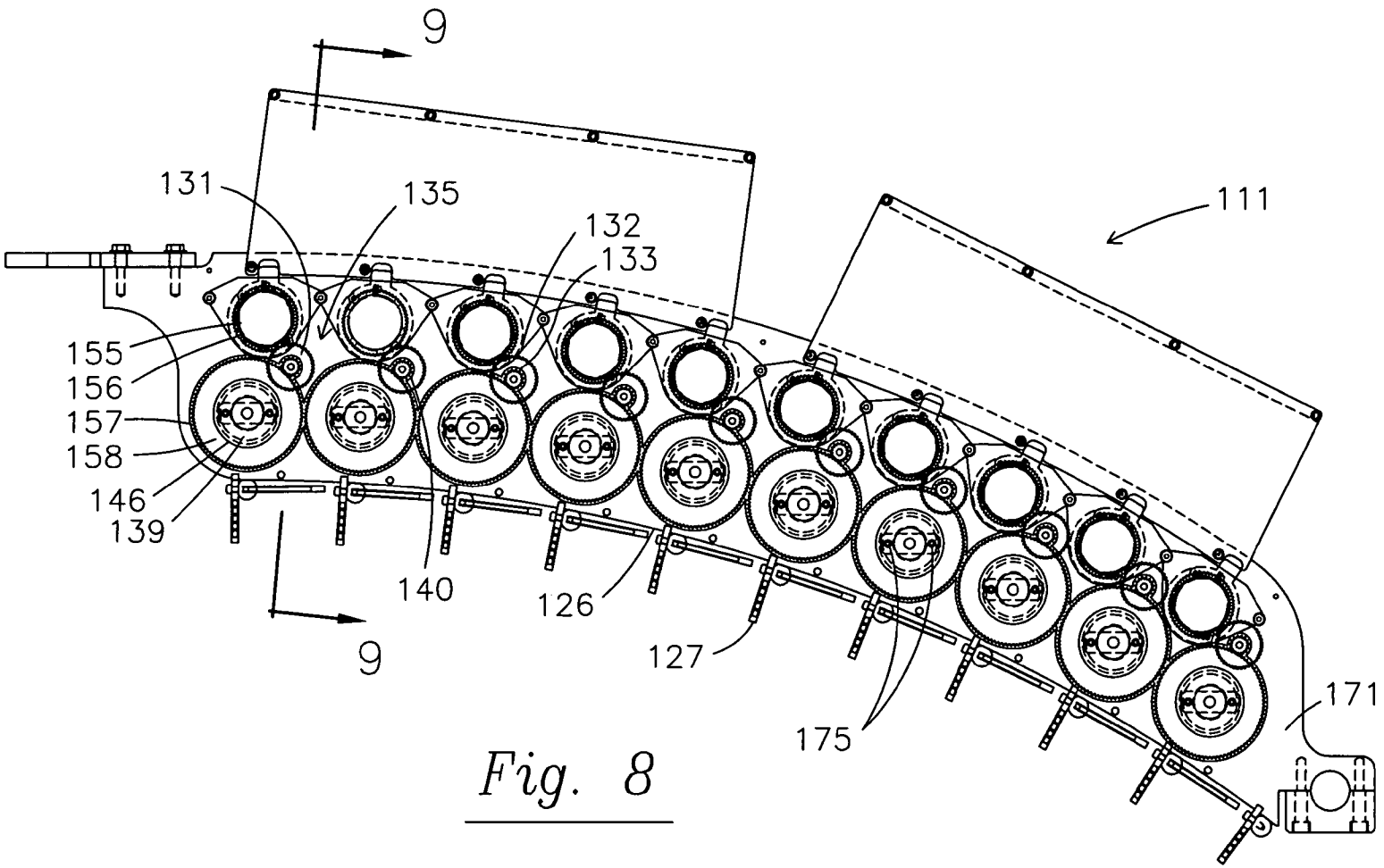
FIG. 8 is a side elevation view of a preferred embodiment of a double-end pattern control yarn feed support.
Figure 10:
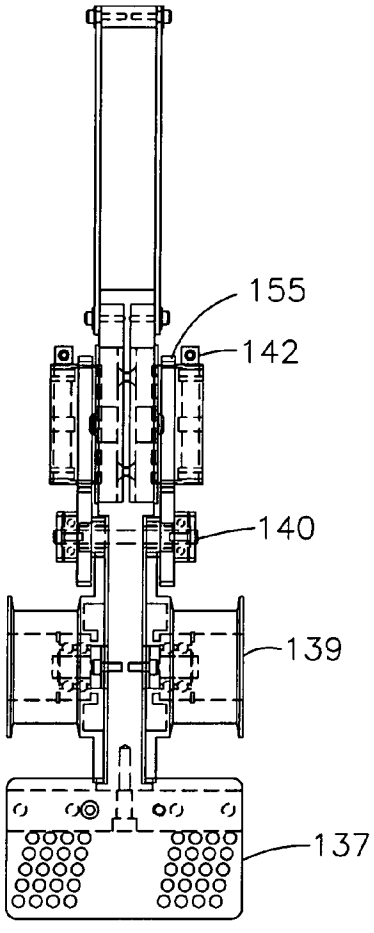
FIG. 10 is another rear elevation view with some detail removed to better illustrate the gear interfaces.
Figure 9:
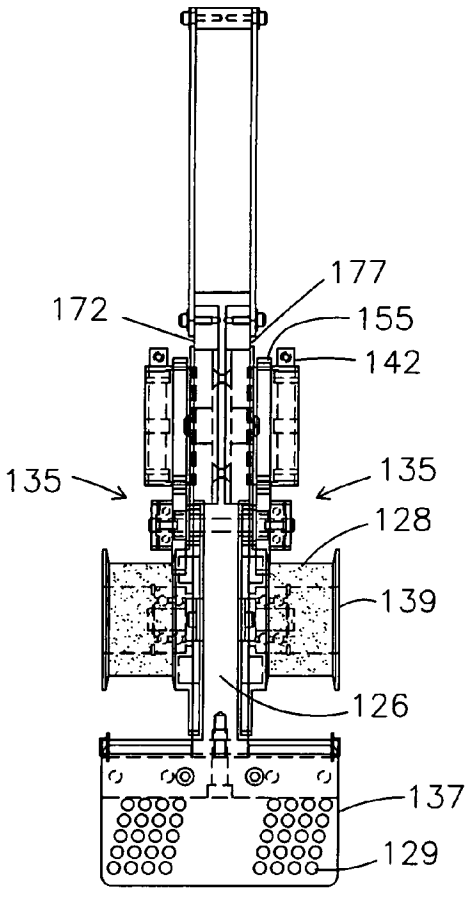
FIG. 9 is a rear elevation view of a section of a support bar with a servo driven yarn feed roll and intermediate reducing gear on each side.

FIGS. 8–10 present an alternative double end yarn feed. The structure of FIG. 8 can also be easily modified by the simple substitution of yarn feed rolls and yarn guide plates to operate as a single end servo scroll pattern attachment. FIG. 8 shows an array of yarn drives 135 assembled on an arching support bar 126 that are mounted across the front and in some instances also the back of tufting machine 10. Support bars 126 have opposed mounting surfaces 171 and opposite surface 172 (shown in FIG. 9). On the opposing side facing surfaces 171,172, are preferably mounted a total of twenty servo motors 131 and driven yarn feed rolls 139, ten on each side. In addition, intermediate gear wheels 140 are placed in communication between servo motors 131 and yarn feed rolls 139. The number of servo motors and yarn feed rolls on each support bar 126 may be varied as discussed in connection with previously described embodiments.

Each double end yarn drive 135 on pattern attachment 111 consists of a yarn feed roll 139 and intermediate gear 140 and a servo motor 131. Preferably, yarns are directed by yarn guide plates 127 so that yarn is wrapped around a substantial portion of the yarn feeding surface 128 of the yarn feed rolls 139 (as shown in FIG. 9). The improved pattern attachment 111 in FIG. 8 is designed to increase the torque applied by servo motors 131 to yarn feed rolls 139. This is accomplished by mounting a drive gear 155 having gear teeth 156 that mesh with large circumference portion gear teeth 132 of intermediate gear 140. When servo motor 131 rotates and correspondingly causes drive gear 155 (which is held in place by clamp 142) to similarly rotate, the result is that intermediate gear 140 rotates in the opposite direction and at a slightly higher rate of rotation due to the slightly smaller diameter and fewer gear teeth 132 in comparison to diameter of gear 155 and number of gear teeth 156. However, intermediate gear 140 has a second smaller diameter section with substantially fewer gear teeth 133 that interface with gear teeth 157 on the very large diameter at gear portion 158 of yarn feed roll 139. Because the smaller diameter section teeth 133 are only between ½ to ¼ as numerous as the larger diameter section teeth 132, the effect of intermediate gear 140 is to require about two or three times as many revolutions of servo motor 131 to accomplish a revolution of yarn feed roll 139. The result of employing the intermediate gear is that the maximum yarn feed rate is diminished and the effective torque of yarn feed drives 131 is increased by a factor of more than 2. Because the larger geared portion 138 of yarn feed rolls 139 and the smaller diameter teeth 133 of intermediate gear 140 are recessed into support 126 while yarn drive gear 155 and larger diameter section 132 at intermediate gear 140 are raised upon surfaces 171,172 of supports 126, it is possible to arrange a compact array of ten yarn feed drives 135 on each opposed surface 171,172 of support 126. FIG. 9 is a sectional view taken along 9—9 in FIG. 8. In this view the apertures 129 of yarn guide plate 137 as well as the opposed position of a pair of yarn feed drives 135 are illustrated. A particular advantage of this construction with a servo motor driven gear 155 and intermediate gear 140 to drive yarn feed roll 139 is that the yarn feed roll 139 rotates in the same direction as the servo motor 131. In this fashion the programming utilized in connection with the pattern attachments shown in FIGS. 1–4 where the servo motors directly drive yarn feed rolls, does not require adjustment. In the alternative construction of FIG. 5 the servo motors rotate in the opposite direction of the yarn feed rolls, and it is necessary to utilize different programming to compensate for this characteristic.

Figure 11:
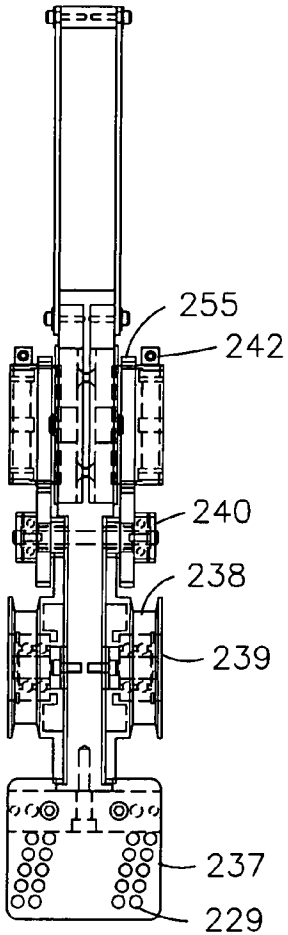
FIG. 11 is a rear elevation view of a single end servo scroll adapted to the same servo motor and gearing arrangement as the double end scroll.

A further advantage of the embodiment of FIG. 8 is that in order to convert an attachment from a double end yarn feed drive to a single end yarn feed drive, the only changes required are the replacement of yarn feed rolls 139 with relatively wide yarn feeding surfaces 128 and the replacement of relatively guides 137. FIG. 11 illustrates the pattern attachment of FIG. 8 in which single end yarn feed rolls 239 and narrower single end yarn guide plates 237 have been substituted. The resulting high torque single end yarn drive can be constructed with very few modifications to components utilized in the improved double end yarn feed drive. While the use of an intermediate gear 140 does introduce the possibility of some lost motion in driving yarn feed rolls 139, bolts 175 permit yarn feed roll 139 to be adjusted in the direction of the axis of intermediate yarn feed roll 140 and thereby minimize any play or slack in the gears.

Figure 12:
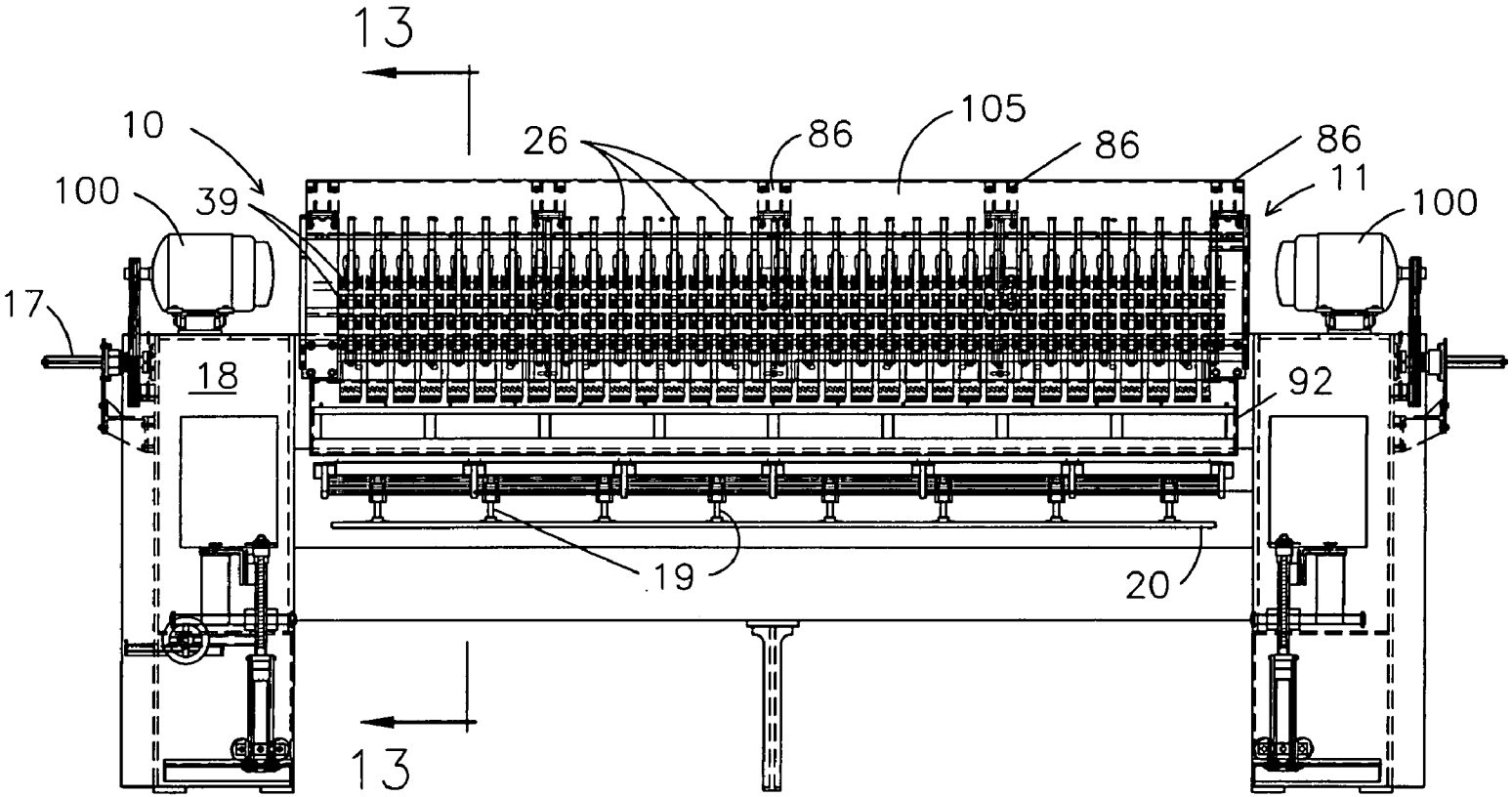
FIG. 12 is a front view of a tufting machine carrying double end pattern control yarn feed supports and a tube bank according to the present invention.
Figure 13:
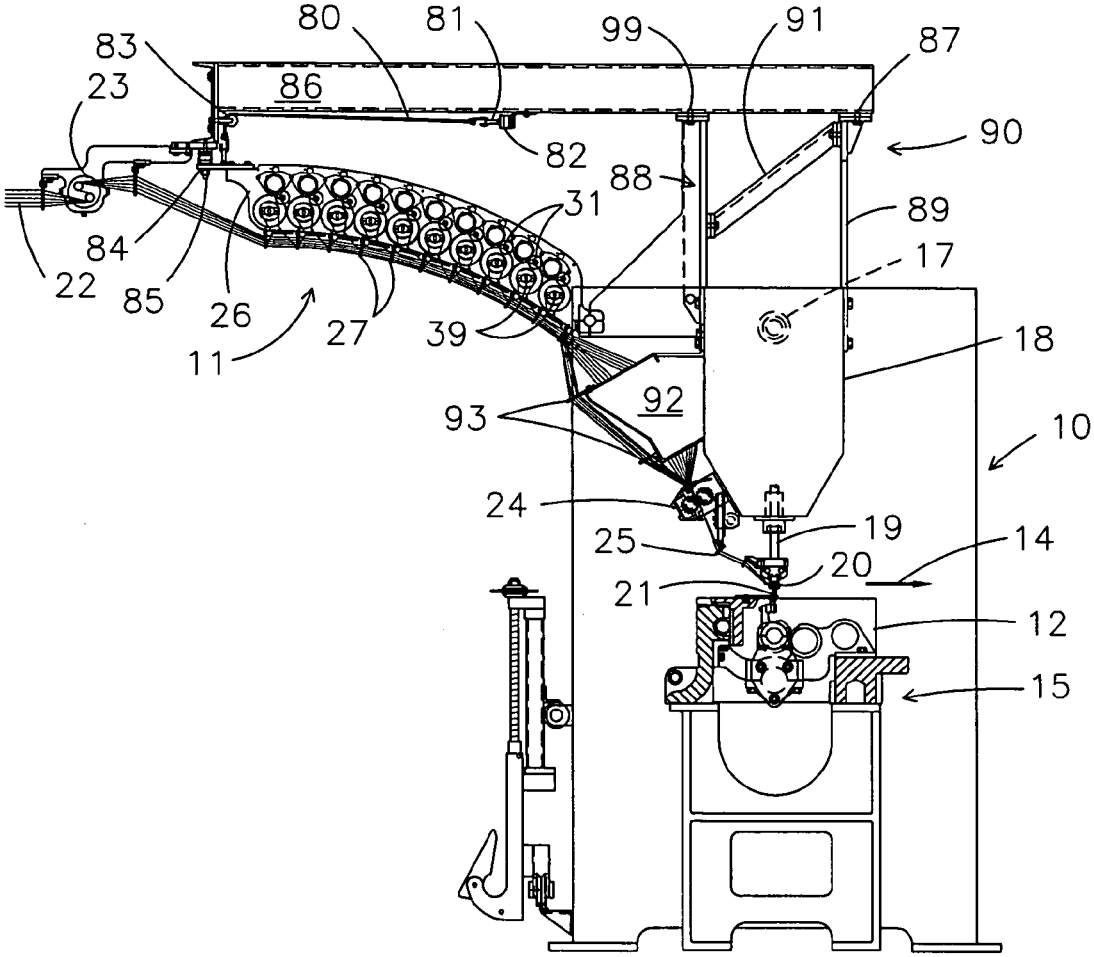
FIG. 13 is a sectional view of the tufting machine of FIG. 12 along line A—A.

Referring now to FIGS. 12 and 13, a tufting machine 10 with an alternative mounting of double end scroll pattern attachment 11 and tube bank 92 is reflected. A transverse beam 105 at the front of double end pattern attachment 11 is connected to a plurality of longitudinal beams 86 to provide a top support structure for the array of support arms 26 of the double end yarn feed pattern attachment 11. A main drive motor 100 drives a rotary main drive shaft 17 mounted in the head 18 of the tufting machine. Drive shaft 17 in turn causes push rods 19 to move reciprocally toward and away from the base fabric. As reflected in FIG. 13, this causes needle bar 20 to move in a similar fashion. Needle bar 20 supports a plurality of preferably uniformly spaced needles 21 aligned transversely to the fabric feed direction 14.

In operation, yarns 22 are fed through tension bars 23 into the double end pattern control yarn feed device 11. After exiting the yarn feed device 11, yarns 22 are fed either into tube bank 92, or alternatively through tube bank yarn guides 93, and then in a conventional manner through yarn puller rollers 24 and yarn guides 25 to needles 21. In order to place the double end pattern control yarn feed attachment 11 at an appropriate position for use with tube bank 92, an extender 90 having front wall 88, back wall 89, internal cross beam support 91 and side walls (not shown) is mounted to the head 18 of the tufting machine 10. The upper support structure of beams 86, 105 is then secured to this extender 90 by mounting plates 99, 87 at the tops of front and back walls, 88, 89.

Additional features of the double end pattern control yarn feed attachment 11 include a separator or bumper 84 and bolt 85 which permits support arms 26 to be removably secured at their front ends to the upper support structure. In order to prevent support arms 26 from pivoting out of control, elastic cord 80 is secured at one end to mounting bracket 82 and eyelet 81 beneath longitudinal supports 86, then around pulley 83 and then attached to a forward end of each arch support 26. The restraint of cord 80 prevents arch supports 26 from falling precipitously when bolts 85 are released in order to permit support arms 26 to pivot down for maintenance of servo motors 31, yarn feed rolls 39, or the threading of yarns about yarn feed rolls 39 and through yarn guides 27.

Figure 14:
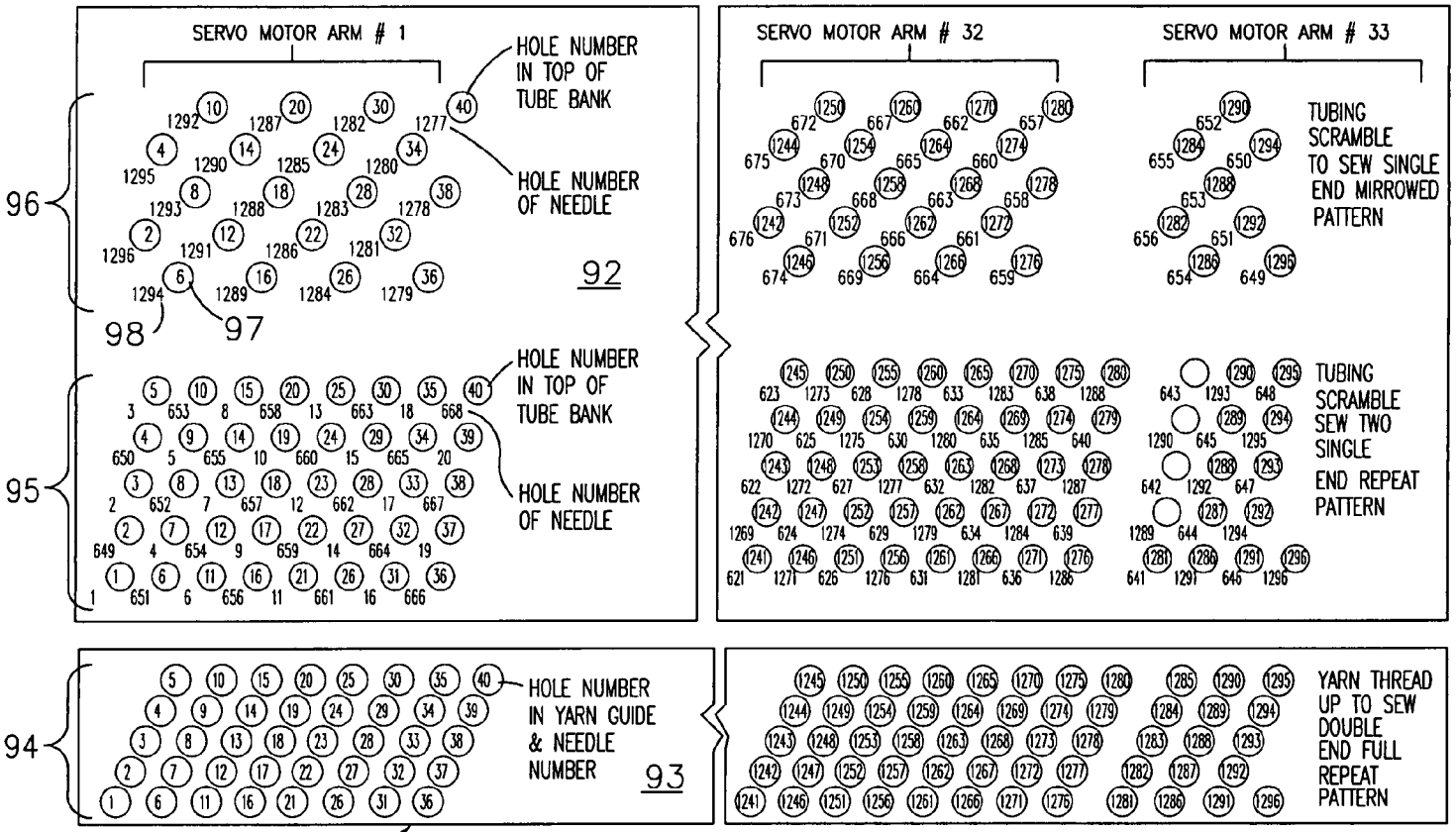
FIG. 14 is a schematic view of the openings in a tube bank and yarn guide used to practice the invention across the full width of a 1296 needle tufting machine.

FIG. 14 reflects the tube bank 92 and tube bank yarn guide 93 utilized to provide either traditional double end yarn patterns across the width of the tufting machine or alternatively two related single end definition patterns. In order to produce the traditional double end pattern across the full width of the tufting machine, yarns exiting the double end pattern control yarn feed attachment 11 are simply fed into tube bank yarn guide 93 with the two yarns from the first motor, designated yarns 1 and 2, being fed into holes designated 1 and 2 on the yarn guide and then to needles 1 and 2 on the tufting machine. The patterns produced are generally as reflected in FIG. 6, and have only a double gauge definition. It will be understood that the particular designations of FIG. 14 are for a tube bank intended for use on a four meter wide, one-eighth gauge tufting machine having 1296 yarn ends. Such a tufting machine will have 648 double end yarn drives in the double end pattern control yarn feed attachment 11. A typical configuration for the pattern attachment 11 would have 33 support arms 26, each carrying twenty yarn feed drives, except that one arm 26 would only be required to carry eight yarn feed drives.

Accordingly, when desired to utilize tube bank 92 to tuft two single end definition patterns, the lower set of apertures 95 in tube bank 92 are utilized. Yarns 1 and 2 from the first servo motor are threaded into apertures 1 and 2 and then fed respectively to needles 1 and 649 on the tufting machine. Similarly, yarns 3 and 4 from the second servo motor are fed into apertures 3 and 4 and thence to needles 2 and 650 respectively. Thus, a first yarn from each of the 648 double end yarn drives is fed to its corresponding needle 1 through 648. The second yarns from each yarn drive are directed respectively by the tube bank to needles 649 through 1296. Accordingly, the tufting machine will tuft two identical patterns at single gauge definition across the width of the tufting machine. Of course, while the heights of the yarns tufted in the two patterns are necessarily identical, it is possible to thread the tufting machine with one pallet of yarn colors for direction through the odd numbered yarn apertures to create the first repeat and a distinct pallet of colors to be threaded through the even apertures to form the second repeat and thereby simultaneously tuft two carpets of substantially identical yarn height pattern, but of varied colors.

Another optional variation of tube bank 92 is to utilize additional apertures 96 for the second or even-numbered yarns on each double end yarn drive. The yarn tubes attached to these second apertures are designed to create a mirrored pattern rather than an identical pattern as the first apertures in the previously described set 95. In order to create the mirrored pattern of two carpets having single end definition, again the first yarns from each of the 648 yarn drives are threaded through the odd numbered apertures in the lower group 95. However, the second yarns designated by even numbers are now threaded through the upper group of apertures 96. In this fashion, the first (odd) yarn from the first motor is fed to the first needle on the tufting machine, and the second (even) yarn from the first motor is fed to the $1296^{th}$ or last needle on the tufting machine. The first yarn from the second motor is fed through the opening designated 3 to needle number 2, while the second yarn from the second motor is fed through the opening designated 4 in the upper group 96 and proceeds to needle 1295. Finally, the last, or $648^{th}$, yarn drive feeds its first (odd) yarn through aperture 1295 to the $648^{th}$ needle, and its second (even) yarn designated 1296 through the corresponding upper tube bank aperture to needle 649.

FIG. 15 reflects patterns created utilizing the tube bank configurations 95, 96 on a simplified ten needle, five double end servo drive pattern. It is possible to practice the invention on smaller sets of needles than the entire width of the tufting machine though typically in groups of several dozen rather than only ten, or the ten needles illustrated may be considered as a surrogate for the entire tufting machine width. Yarn rolls are sequentially designated A–E. FIG. 15A shows the threading of yarns from first roll A to needles one and six and that the pattern tufted on needles sequentially designated one through five is of single end definition and identical to the pattern tufted at high (H), medium (M) and low (L) heights on the adjacent group of needles sequentially designated six through ten. FIG. 15B is a facsimile of the appearance created by the high, medium and low yarn feeds in a fashion similar to that depicted in FIG. 6B for a double gauge definition pattern. The patterns reflected in FIGS. 15A and B would be obtained in full tufting machine width by feeding all yarns from the yarn drives through lower apertures 95 of tube bank 92. In contrast, the tufting reflected in FIGS. 15C and D is of mirrored patterns. In this example, yarns from first yarn drive A are fed to needles one and ten, and yarns from the fifth and final yarn drive E are fed to needles five and six. The resulting pattern created by needles sequentially designated one through five has its mirror image in the single end definition pattern created by needles sequentially designated six through ten. FIG. 15D reflects a facsimile of the pattern that would be tufted when giving account to high, medium and low yarn feeds for each stitch. This mirror image pattern of FIGS. 15C and D is created in full tufting machine width by feeding first yarns from each of yarn drives A through E through tube bank in the lower set of apertures 95 and feeding second yarns through the upper set of apertures 96. Again, with mirror image patterns, it is also possible to utilize different color pallets for the first or odd numbered yarns in contrast to the second or even numbered yarns to create mirror image carpets in respect to yarn heights but having different colors.

The utilization of tube bank 92 and tube bank yarn guides 93 of the present invention provides a tufting machine operator with the option of creating full width carpets in double gauge definition or alternatively creating two single gauge definition carpets of half width, which may be especially suitable for use as rugs.

While preferred embodiments of the invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those skilled in the art that the present invention is not limited thereto since many modifications can be made. Therefore, it is contemplated that any and all such embodiments are included in the present invention as may fall within the scope or equivalent scope of the appended claims.

We claim:

1. In a multiple needle tufting machine adapted to feed a backing fabric longitudinally from front to rear through the machine having a plurality of spaced yarn carrying needles aligned transversely of the machine for a reciprocal movement through the backing fabric to form a tufted carpet, a yarn feed mechanism comprising:

(a) an array of sequentially designated yarn drives each configured to carry a first yarn and a second yarn proceeding from a yarn supply to a first and a second needle respectively of the plurality of spaced apart yarn carrying needles; and (b) a tube bank intermediate the array of yarn drives and plurality of yarn carrying needles wherein the tube bank directs first yarns from the array of sequentially designated yarn drives to the first needles comprising a first sequential group of the spaced yarn carrying needles to form a first repeat and directs second yarns from the array of sequentially designated yarn drives to the second needles comprising a second sequential group of the spaced yarn carrying needles to form a second repeat; wherein the first repeat of the tufted carpet may be separated from the second repeat of the tufted carpet to form first and second rugs.

2. The yarn feed mechanism of claim 1 wherein the order of the yarns directed to the first sequential group of yarn carrying needles is the same as the order of the yarns directed to the second sequential group of yarn carrying needles.

3. The yarn feed mechanism of claim 1 wherein the order of the yarns directed to the first sequential group of yarn carrying needles is in the reverse order of the yarns directed to the second sequential group of yarn carrying needles, so that the second repeat is a mirror of the first repeat.

4. A method of tufting a carpet by feeding a backing fabric through a tufting machine of the type having a plurality of spaced needles aligned to form a row transverse to the machine for reciprocal movement through the backing fabric, a yarn supply, and a yarn feed mechanism having about one-half as many independently controlled servo motors as there are needles in the transverse row comprising the steps of:

(a) feeding yarns from the yarn supply to the yarn feed mechanism;

(b) placing first and second yarns on a servo driven yarn feed drive in the yarn feed mechanism;

(c) feeding the first and second yarns from the yarn feed mechanism into a tube bank;

(d) distributing the first yarns via the tube bank to a first sequential group of needles; and (e) distributing the second yarns via the tube bank to a second sequential group of needles.

5. The method of claim 4 wherein the first yarns fed to the first sequential group of needles tuft a first repeat and the second yarns fed to the second sequential needles tuft a second repeat.

6. The method of claim 4 wherein the first and second repeats are cut apart to form rugs.

7. The method of claim 5 wherein the first and second repeats are substantially identical.

8. The method of claim 5 wherein the second repeat is a mirror of the first repeat.

9. A tufting machine comprising a transverse row of spaced needles adapted for reciprocal penetration of a backing fabric;

a drive to move the backing fabric longitudinally past the transverse row of needles;

a yarn feed mechanism having about one-half as many independently controlled yarn feed drives as needles in the transverse row;

a tube bank having two openings for each yarn feed drive configured to feed a first yarn from a yarn feed drive to a first repeat and a second yarn from said yarn feed drive to a second repeat.

10. The tufting machine of claim 9 wherein the first repeat and the second repeat are substantially identical.

11. The tufting machine of claim 9 wherein the second repeat is a mirror of the first repeat.

12. The tufting machine of claim 9 further comprising a set of yarn guides permitting yarns to be fed directly from yarn feed drives to the transverse row of needles without passing through the tube bank.

13. In a multiple needle tufting machine adapted to feed a backing fabric longitudinally from front to rear through the machine having a plurality of spaced needles aligned transversely of the machine for reciprocal movement and penetration of the backing fabric, a pattern control yarn feed mechanism comprising:

an array of yarn feed drives having a yarn feed roll and a servo motor, the number of yarn feed drives numbering about one-half the number of transversely aligned needles;

a controller which electronically receives information relating to the reciprocal movement of the needles, and electronically sends corresponding ratiometric pattern information to the servo motors;

pairs of first and second yarns being fed into the yarn feed mechanism, each pair of yarns being driven by a separate yarn feed drive;

the servo motors of the array of yarn feed drives being independently operable at different speeds in accordance with a carpet pattern.

14. The pattern control yarn feed mechanism of claim 13 wherein the controller electronically communicates ratiometric information to servo motor controllers and the servo motor controllers electronically direct servo motors to rotate yarn feed rolls the distance to feed the appropriate yarn amount for each stitch.

15. The pattern control yarn feed mechanism of claim 13 wherein the servo motors electronically provide positional control information to an associated servo controller.

16. The pattern control yarn feed mechanism of claim 13 further comprising a tube bank feeding first yarns to a first repeat and second yarns to a second repeat.

17. The pattern control yarn feed mechanism of claim 16 wherein the first and second repeats are substantially identical.

18. The pattern control yarn feed mechanism of claim 16 wherein the second repeat is a mirror of the first repeat.

19. A multiple needle tufting machine comprising:

(a) a row of transversely aligned yarn carrying needles adapted for reciprocal penetration of a backing fabric;

(b) a backing fabric feed mechanism adapted to feed the backing fabric longitudinally through the tufting machine;

(c) a pattern control yarn feed mechanism comprising an array of independent servo motor driven yarn feed drives, wherein the number of yarn feed drives is about one-half the number of yarn carrying needles;

(d) pairs of first and second yarns, each pair of yarns being associated with a separate yarn feed drive so that both the first and second yarns are fed to tuft stitches of the same height in the backing fabric.

20. The multiple needle tufting machine of claim 19 wherein the pairs of first and second yarns are fed to adjacent yarn carrying needles.

21. The multiple needle tufting machine of claim 19 wherein a tube bank directs first yarns to a first repeat and second yarns to a second repeat.

22. The multiple needle tufting machine of claim 21 wherein the first repeat and the second repeat are substantially identical.

23. The multiple needle tufting machine of claim 21 wherein the second repeat is a mirror of the first repeat.

* * * * *